US006951369B1

(12) United States Patent
Wang et al.

(10) Patent No.: US 6,951,369 B1
(45) Date of Patent: Oct. 4, 2005

(54) COMBINATION STRUCTURE OF SWING CHAIR USED IN YARD

(75) Inventors: Teng Yi Wang, Taipei (TW); Chang I Wu, Taipei (TW)

(73) Assignee: Shen-Tai Industry Co., Ltd., Taipei (TW)

( * ) Notice: Subject to any disclaimer, the term of this patent is extended or adjusted under 35 U.S.C. 154(b) by 0 days.

(21) Appl. No.: 10/860,006

(22) Filed: Jun. 4, 2004

(51) Int. Cl.[7] ..... A63G 9/02
(52) U.S. Cl. ..... 297/281; 297/273
(58) Field of Search ..... 297/281, 273

(56) References Cited

U.S. PATENT DOCUMENTS 5,564,987 A * 10/1996 Ayrolles ..... 297/281 X
6,402,233 B1 * 6/2002 Tseng ..... 297/281 X
6,582,018 B2 * 6/2003 Tseng ..... 297/281
6,672,665 B1 * 1/2004 Tseng ..... 297/281
2003/0071499 A1 * 4/2003 Tseng ..... 297/281

* cited by examiner

*Primary Examiner*—Rodney B. White
(74) *Attorney, Agent, or Firm*—Troxell Law Office, PLLC

(57) ABSTRACT

The structure has two lateral racks of which the upper ends can be mutually connected by using a top transverse rod which is optionally of a fixed or movable type, and a swing chair having swayable connecting members on its upper end to connect the top transverse rod pivotally; a front end of each rack is curved and extends down and frontwards at an area nearly of a middle point of it; the top of the front foot can be fixedly connected to the top transverse rod, while the bottom of the front foot can be put on the ground in an assembled state; a shorter rear foot of the rack is curved and extends down and rearwards, its top pivotally and movably connects the front foot at an area nearly of the middle point of the latter; a movable positioning piece is provided between the front and the rear feet, one end of the movable positioning piece pivotally and movably connects an area near the bottom of one of the two feet, while the other end is movably slipped over and positioned on the other foot.

6 Claims, 8 Drawing Sheets

COMBINATION STRUCTURE OF SWING CHAIR USED IN YARD

BACKGROUND OF THE INVENTION

1. Field of the Invention

The present invention is related to a combination structure of a swing chair used in a yard, and especially to a swing chair able to be folded to get a reduced volume not occupying much space when it is not in use or is packaged for shipping, a user can thus be convenient to make positioning and assembling of the swing chair.

2. Description of the Prior Art

Generally, the structure of a swing chair used in a yard mainly has a swing chair pending between two mutually separated lateral racks to seat for leisure; the swing chair can be swayed with a force exerted by a user.

In order to make pending swaying of swing chair, the two mutually separated lateral racks have to be supporting members standing on the ground to supporting the entire swing chair in the yard, the racks must also be connecting members for assembling rods of the pending swing chair. Therefore, the lateral racks of such a swing chair used in a yard generally must be of predetermined height and material.

However, in the structure of a swing chair used in a yard presently, the two mutually separated lateral racks are mostly fixed, so that all the members of the swing chair must be packaged in a quite large volume after production in a factory, this makes the cost of transportation and shipping very high. And if the swing chair is made to be assemblable, a user involved must make connection of many parts with tools in a cumbersome way, this not only increases the complexity of the entire swing chair product, but also makes assembling after purchasing of the user quite cumbersome.

SUMMARY OF THE INVENTION

The primary object of the present invention is to provide a swing chair combination structure for use in a yard, the structure renders all the members of the swing chair able to be folded to get a volume not occupying much space when it is not in use or is packaged for shipping, a user can thus be convenient to quickly make positioning in assembling the swing chair after purchasing without using any tool.

Therefore, in order to achieve the above stated object, the present invention provides two lateral racks in mutually symmetric shapes, the upper ends of the lateral racks can be mutually connected by using a top transverse rod which can be optionally of a fixed or movable type; a pending swing chair has swayable connecting members on its upper end to pivotally connect with the top transverse rod; the top transverse rod on the top of the swing chair can be covered with a top covering of predetermined sizes and area; each of the lateral racks includes a front foot and a rear foot respectively of specific lengths; the front foot is curved and extends downwards and frontwards at a position nearly of a middle point of the front foot itself; the top end of the front foot can be fixedly connected to the top transverse rod, while the bottom end of the front foot can be put on the ground in an assembled state; the rear foot is shorter and is curved and extends downwards and rearwards, the top end of the rear foot is pivotally and movably connected with the front foot at a position nearly of the middle point of the latter, while the bottom end of the rear foot can be stretched away and placed on the ground to be spaced a predetermined distance from the bottom end of the front foot; a movable positioning piece is provided between a front foot and a rear foot, one end of the movable positioning piece is pivotally and movably connected with the area near the bottom of one of the two feet, while the other end of it is movably slipped over and positioned on the other of the two feet.

In a preferred embodiment, one end of the movable positioning piece is normally pivotally and movably connected with the area near the bottom of the front foot by means of a pivotally connecting pin, the other end of the movable positioning piece has a bending hooking end; in corresponding to the structure of the movable positioning piece, the rear foot is provided on the outer lateral side near the bottom thereof with a sleeve.

In a practicable embodiment, the above stated swing chair is composed of the foldable-for-stacking members including a seat portion, a chair back and two lateral armrests assemblable individually; for each of the two lateral armrests, a swayable connecting member has its upper end pivotally and movably connected with a top transverse rod and has its lower end assembled with the lateral armrest.

In another practicable embodiment, each of the two lateral armrests of the above stated swing chair is composed of a straight pipe having its bottom end pivotally and movably connected with an outer edge of the seat portion as well as a resting plate having its rear end connected with the chair back, the upper end of the straight pipe and the front end of the resting plate can be connected with each other; the outer lateral side of the bottom end of the straight pipe and the outer lateral side of the rear end of the resting plate respectively can be provided with connecting bolts, the bottom end of a swayable connecting member can be movably connected with the connecting bolts.

In a preferred embodiment, the above stated connecting bolts have shanks of set sizes and diameters and heads with slightly larger diameters respectively in comparison with those of the shanks, the armrests are provided at the positions in corresponding with those of the connecting bolts with slots having specific vertical lengths, these slots has on their top ends holes slightly larger than the heads of the connecting bolts.

The present invention will be apparent after reading the detailed description of the preferred embodiment thereof in reference to the accompanying drawings.

DETAILED DESCRIPTION OF THE PREFERRED EMBODIMENT

Figure 1:
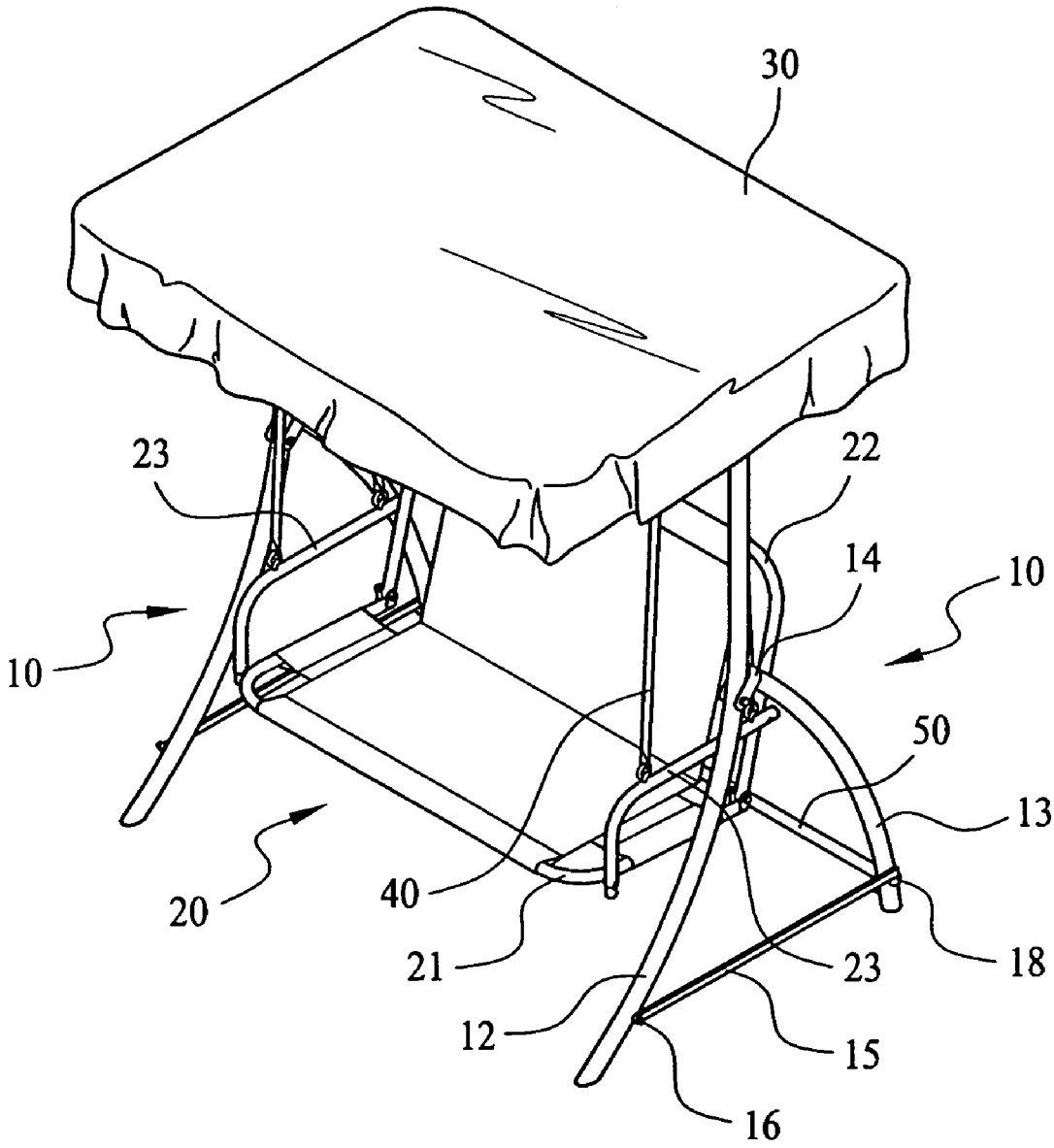
FIG. 1 is a perspective view of a preferred embodiment of the present invention.
Figure 2:
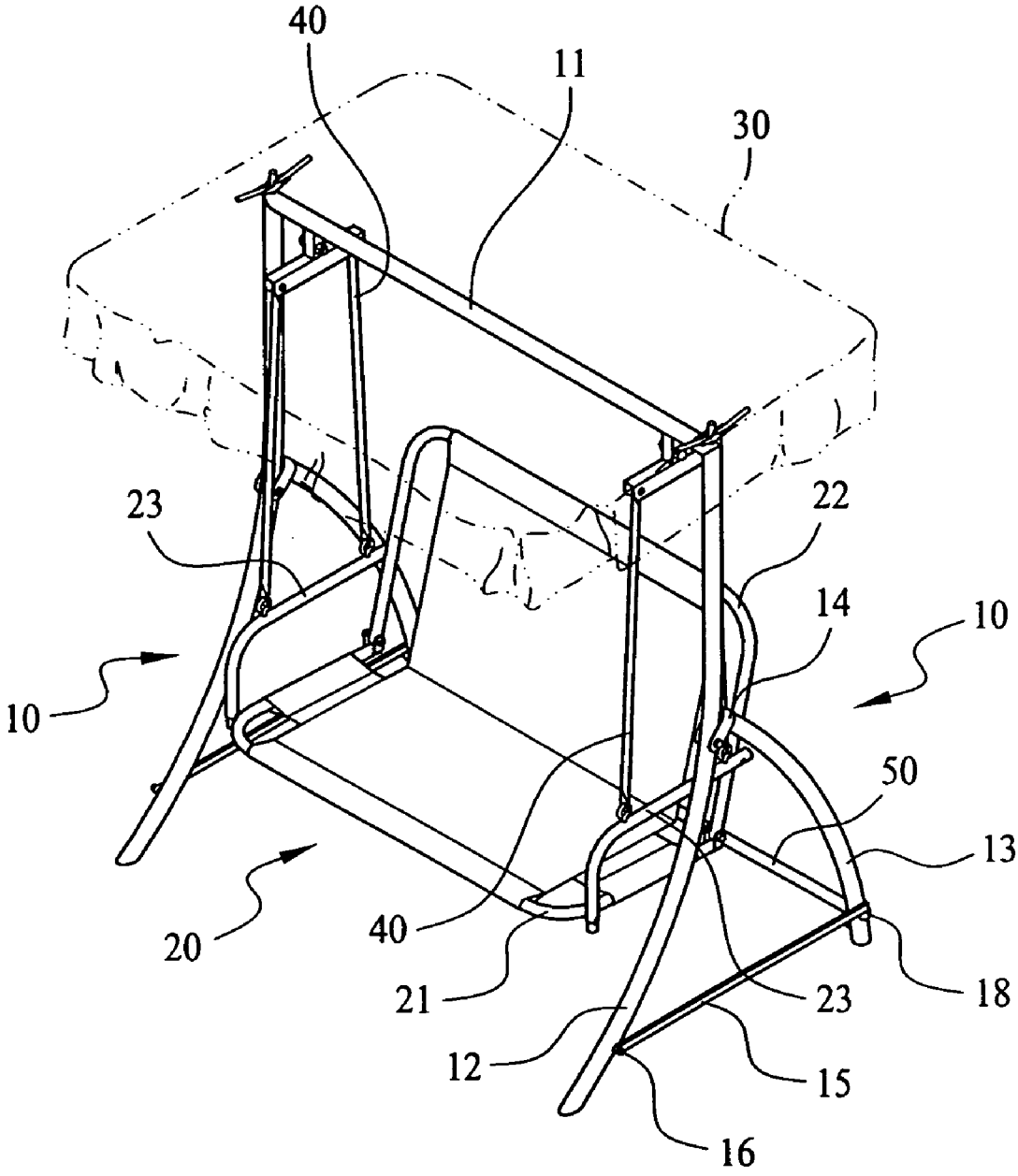
FIG. 2 is a perspective schematic view showing the structure of the embodiment of FIG. 1 in which a top covering is depicted with a phantom line.

Referring firstly to FIGS. 1 and 2, in the preferred embodiment, the present invention provides two lateral racks 10 in mutually symmetric shapes, the upper ends of the lateral racks 10 can be mutually connected by using a top transverse rod 11 which can be optionally of a fixed or movable type. A pending swing chair 20 (a set distance away from the ground) has swayable connecting members 40 on its upper end to pivotally connect with the top transverse rod 11; thereby the entire swing chair 20 can be swayed frontwards and rearwards by an exerted force taking the movable pivotal connecting point on this upper end as a pivot axis. In this embodiment, the top transverse rod 11 is assembled with a top covering 30 of predetermined sizes and area; the top covering 30 can completely cover and protect the swing chair 20.

Figure 3:
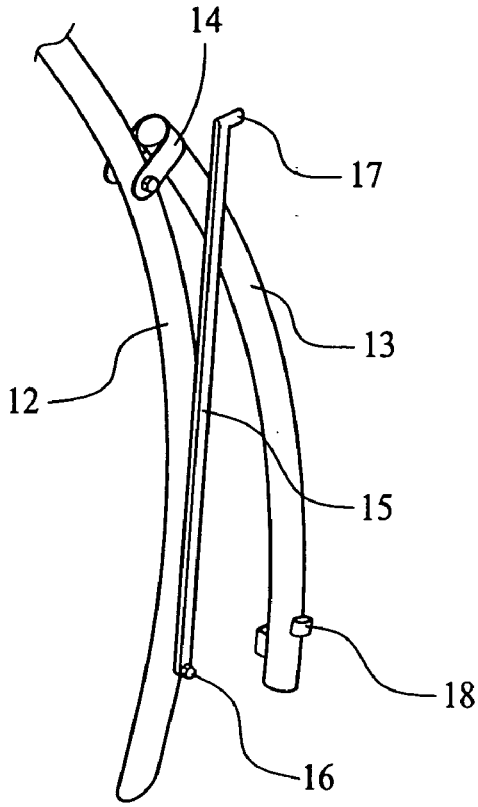
FIG. 3 is a perspective view showing the structure of a foot of a swing chair as shown in FIG. 1 before positioning.

As shown in FIGS. 2, 3, each of the lateral racks 10 includes a front foot 12 and a rear foot 13 of specific lengths (i.e., vertical heights). In this preferred embodiment, the front foot 12 is curved and extends downwards and frontwards at a position nearly of a middle point of it; the top end of the front foot 12 can be fixedly connected to the top transverse rod 11, while the bottom end of the front foot 12 can be put on the ground in an assembled state; the rear foot 13 is shorter and is curved and extends downwards and rearwards, the top end of the rear foot 13 is pivotally and movably connected with the front foot 12 at a position nearly of the middle point of the latter, while the bottom end of the rear foot 13 can be stretched away and placed on the ground to be spaced a predetermined distance from the bottom end of the front foot 12. In this preferred embodiment, the rear foot 13 is pivotally and movably connected with the front foot 12 near the middle point of the latter by means of a U shaped clamp 14.

A movable positioning piece 15 is provided between a front foot 12 and a rear foot 13; one end of the movable positioning piece 15 is pivotally and movably connected with the area near the bottom of one of the two feet 12, 13 while the other end of it is movably slipped over and positioned on the other of the two feet 12, 13. In this preferred embodiment, the movable positioning piece 15 is normally movably and pivotally connected on one end thereof with the front foot 12 at the area near the bottom of the latter by means of a pivotally connecting pin 16, and has on the other end thereof a bent hooking end 17; in corresponding to the structure of the movable positioning piece 15, the rear foot 13 is provided on the outer lateral side near the bottom thereof with a sleeve 18.

Figure 4:
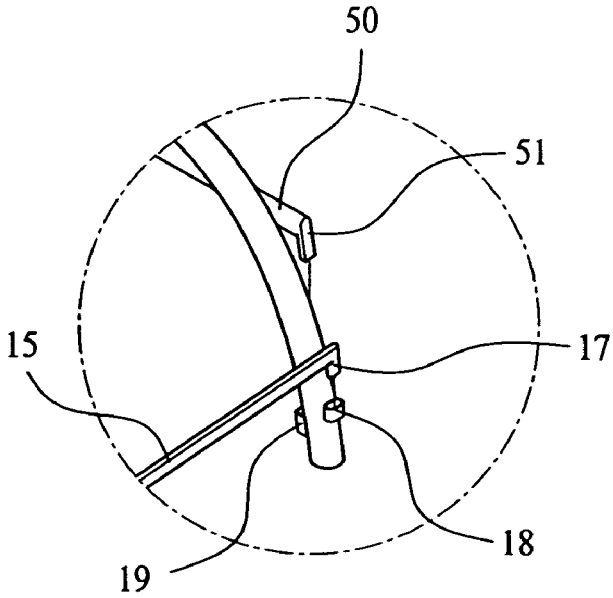
FIG. 4 is a perspective schematic view showing the state being ready for positioning of the foot of the swing chair and a lower transverse rod as shown in FIG. 3.

The above stated structure of the present invention thereby can be folded to get close to the front foot 12 taking the movable pivotal connecting point of the rear foot 13 with the U shaped clamp 14 as a pivot axis (the state as shown in FIG. 3) when it is not in use (or is packaged for shipping); and when it is to be assembled and positioned, the structure is stretched out by turning about the same pivot axis as shown in FIG. 4, then the movable positioning piece 15 is rotated taking its pivotally connecting pin 16 as a pivot axis to make engagement and connection of the bent hooking end 17 with the sleeve 18, now the bottom ends of the front and the rear feet 12, 13, of the two lateral racks 10 can be stretched out and positioned to form the state for use as shown in FIGS. 1 and 2.

Figure 5:
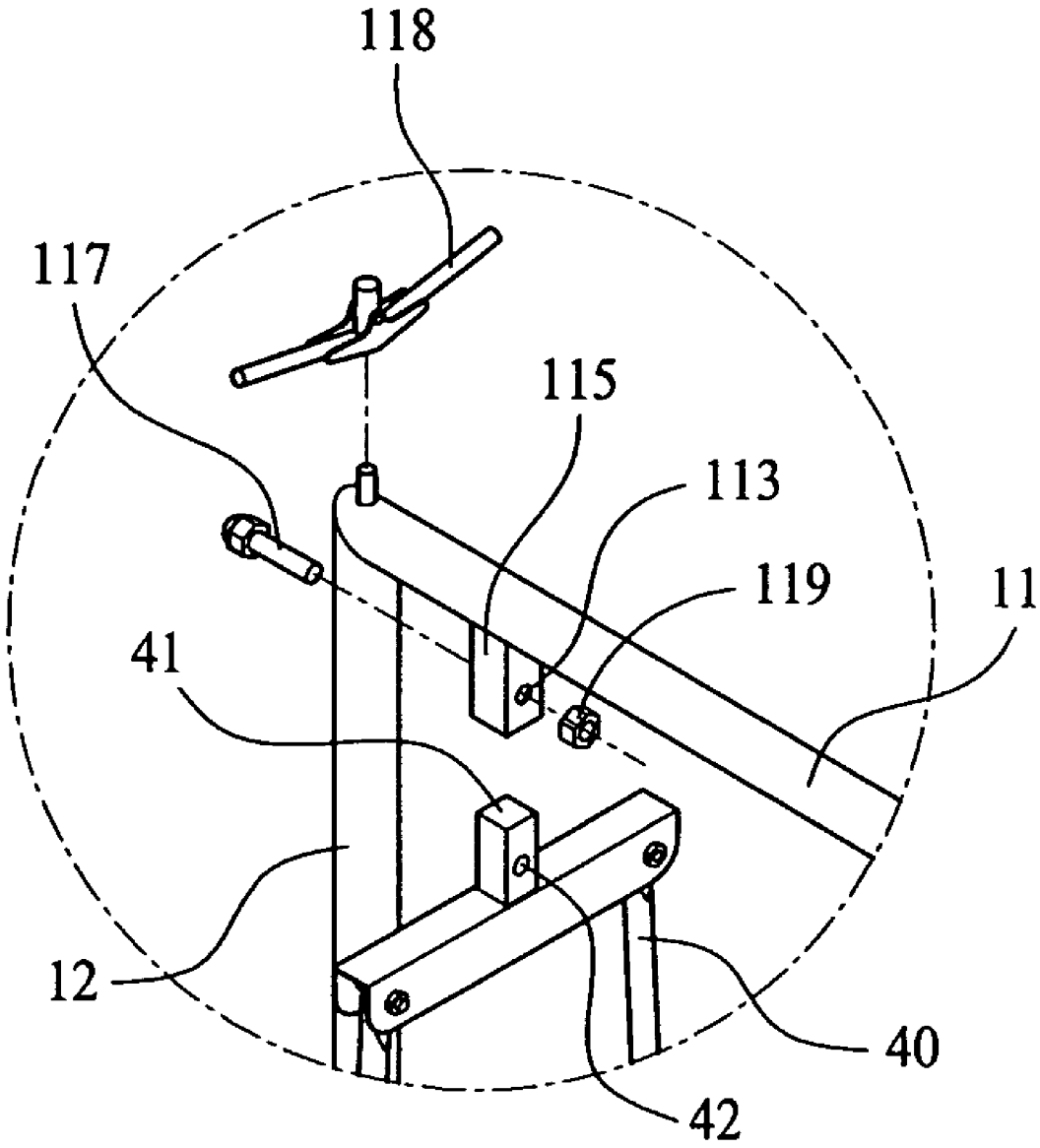
FIG. 5 is a perspective schematic view analytically showing a top transverse rod and the elements on the top of the swing chair of the present invention.
Figure 6:
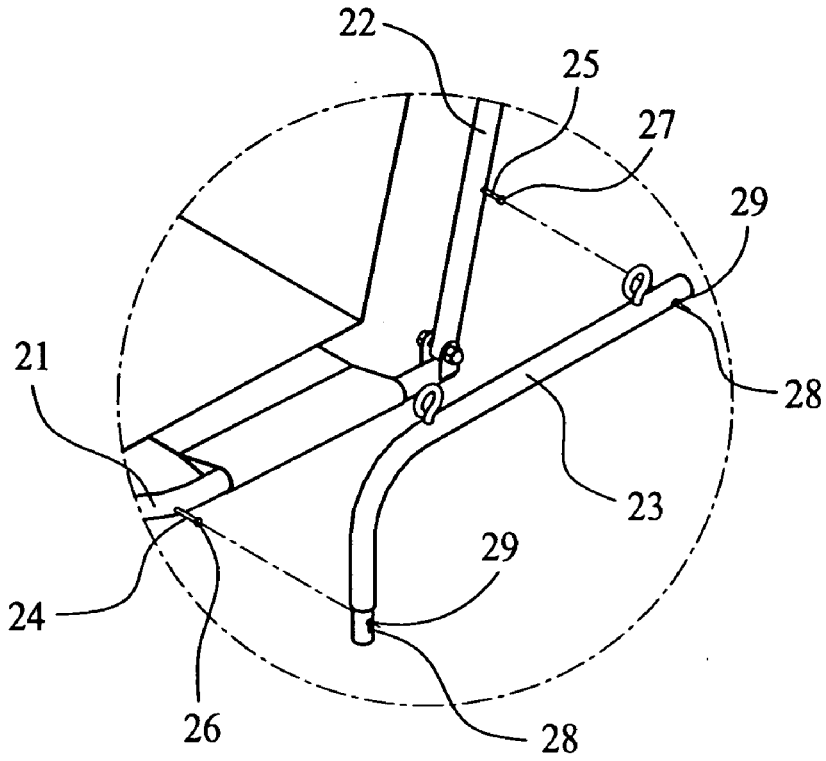
FIG. 6 includes perspective schematic views analytically showing one side of the swing chair and the elements on an armrest of the present invention.
Figure 6:
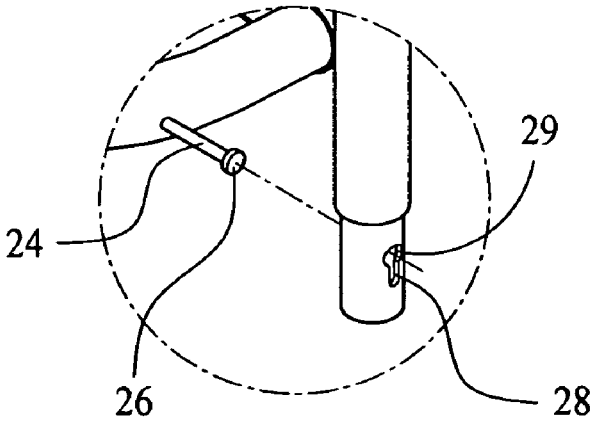

And as shown in FIGS. 2, 5 and 6, in the preferred embodiment, the swing chair 20 is composed of the foldable—for-stacking members including a seat portion 21, a chair back 22 and two lateral armrests 23 assemblable individually; for each of the two lateral armrests 23, one swayable connecting member 40 has its upper end pivotally and movably connected with the top transverse rod 11 and has its lower end assembled with the lateral armrest 23. A bottom transverse rod 50 for reinforcement further can be mounted between the areas near the bottoms of the two the rear feet 13. In the embodiment depicted, in reference to FIGS. 2, 4, the bottom transverse rod 50 can be provided on its two ends with two bent engaging ends 51, the rear feet 13 are provided on their inner sides each with another sleeve 19, so that the bottom transverse rod 50 can be mounted and detached conveniently at any time.

Figure 7:
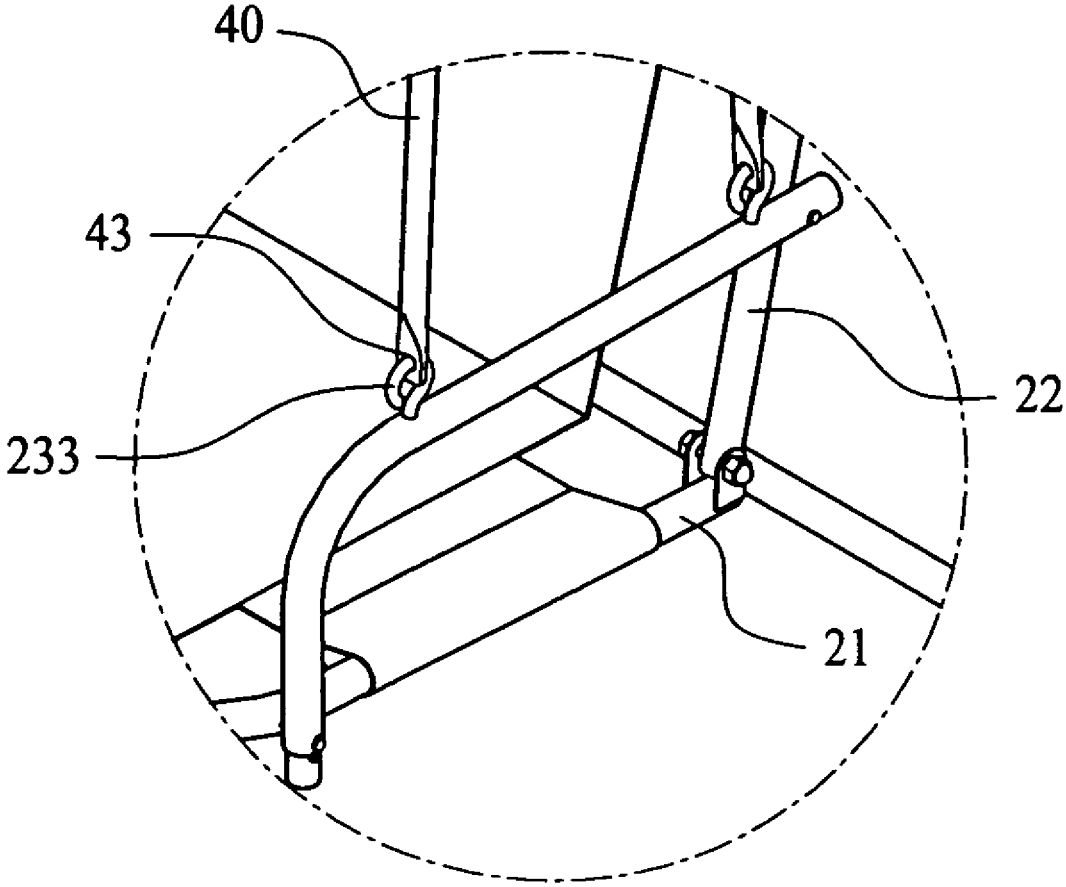
FIG. 7 is a perspective schematic view showing the state that the portion as shown in FIG. 6 has been assembled.

In the preferred embodiment as shown by FIGS. 5–7, the swing chair 20 is provided on the outer lateral sides of the seat portion 21 and the chair back 22 respectively with connecting bolts 24, 25; these connecting bolts 24, 25 respectively have shanks of set sizes and diameters and heads 26, 27 with slightly larger diameters respectively in comparison with those of the shanks; the lateral armrests 23 are provided at the positions in corresponding with those of the connecting bolts 24, 25 with slots 28 having specific vertical lengths, these slots 28 has on their top ends holes 29 slightly larger than the heads 26, 27. The connecting bolts 24, 25 thereby can have their heads 26, 27 extended through the slightly larger holes 29, and then the shanks smaller by size can be positioned in the slots 28 by the action of gravity of the entire swing chair 20.

And in the above stated embodiment as shown in FIG. 5, the top end of either of the above stated swayable connecting members 40 has thereon an insertion piece 41 with a hole 42, the top transverse rod 11 is provided at a corresponding position with a sleeve 115 having a hole 113, so that the insertion piece 41 and the sleeve 115 can be connected by slipping one over the other and by using a bolt 117 and a nut 119. The lower end of either of the swayable connecting members 40 can be assembled by means of a connecting end having a hole 43 for being hooked with a hook 233 provided on the upper surface of either of the lateral armrests 23. And more, the top transverse rod 11 is provided with braces 118 to stretch out, support and make positioning of the top covering 30.

The above stated improved structure of the present invention thereby can have all the members of such a swing chair for use in a yard folded to get a reduced volume not occupying much space when it is not in use or is packaged for shipping; so that when a user is to assemble the swing chair after purchasing, he can do according to the way for the above stated embodiment, only the upper ends of the swayable connecting members 40 need a simple tool to lock the bolts into the nuts, the remaining members can be directly assembled and positioned without any tool. On the contrary, when the swing chair is not in use, it can be detached for storage nearly without using any tool.

Figure 8:
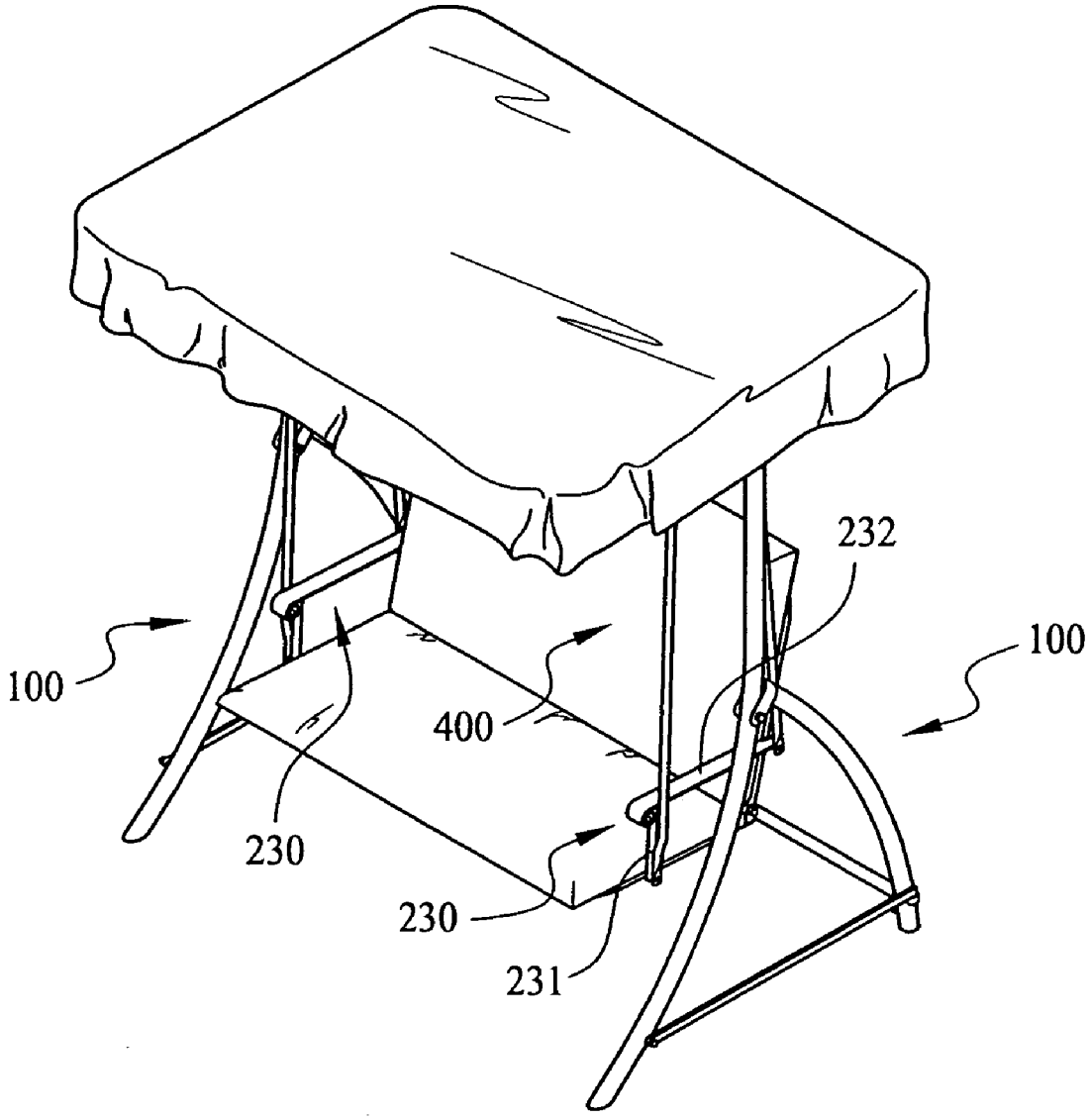
FIG. 8 is a perspective view of another embodiment of the present invention.
Figure 9:
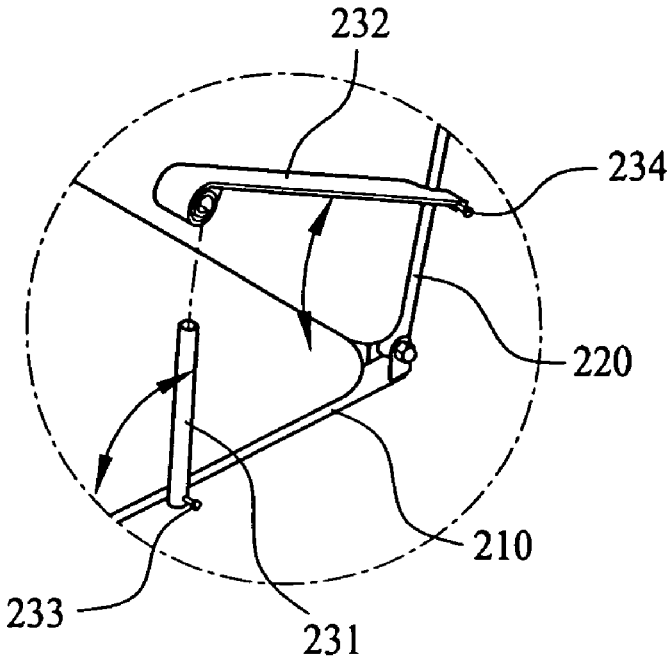
FIG. 9 is a perspective schematic view showing assembling of the armrest of FIG. 8.
Figure 10:
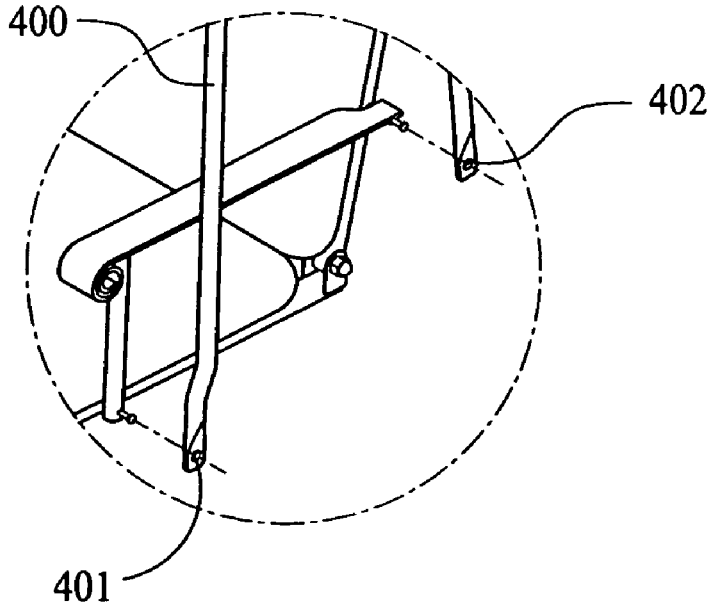
FIG. 10 is a perspective schematic view showing further assembling of connecting members in subsequence to FIG. 9.

In another embodiment of the present invention as shown in FIGS. 8–10, with two lateral racks 100 same as those of the preceding embodiment, two lateral armrests 230 each is composed of a straight pipe 231 having its bottom end pivotally and movably connected with an outer edge of a seat portion 210 as well as a resting plate 232 having its rear end connected with the chair back 220; the upper end of the straight pipe 231 and the front end of the resting plate 232 can be connected with each other. In this preferred embodiment, the outer lateral side of the bottom end of the straight pipe 231 and the outer lateral side of the rear end of the resting plate 232 can be respectively provided with connecting bolts 233, 234, two feet 401, 402 of two lateral pending rods with different lengths of a swayable connecting member 400 can be movably connected with the connecting bolts 233, 234.

The embodiment given is only for illustrating the present invention, and not for giving any limitation to the scope of the present invention; it will be apparent to those skilled in this art that various modifications or changes without departing from the spirit of this invention shall also fall within the scope of the appended claims.

What is claimed is:

1. A combination structure of a swing chair used in a yard, said structure comprises: two lateral racks in mutually symmetric shapes, upper ends of said lateral racks are adapted to mutually connect by using a top transverse rod which is optionally of a fixed or movable type, and a pending swing chair having swayable connecting members on an upper end to pivotally connect with said top transverse rod; said top transverse rod on the top of said swing chair is adapted to being covered with a top covering of predetermined sizes and area; each of said lateral racks includes a front foot and a rear foot respectively of specific lengths; said front foot is curved and extends downward and frontward beginning at a near middle point of said front foot; a top end of said front foot is adapted to fixedly connect to said top transverse rod, while a bottom end of said front foot is adapted to being put on the ground in an assembled state; said rear foot is shorter and is curved and extends downward and rearward, a top end of said rear foot is pivotally and movably connected with said front foot near said middle point of said front foot, while the bottom end of said rear foot is adapted to being pivoted away and placed on the ground to be spaced a predetermined distance from said bottom end of said front foot; a movable positioning piece is provided between said front foot and said rear foot, one end of said movable positioning piece is pivotally and movably connected with an area near the bottom end of one of said front foot and said rear foot, while the other end of said movable positioning piece is slidably movable over and positioned on the other of said front foot and said rear foot.

2. The combination structure of a swing chair used in a yard as in claim 1, wherein one end of said movable positioning piece is pivotally and movably connected with an area near said bottom end of said front foot, while the other end of said movable positioning piece has a bent hooking end; in corresponding to the structure of said movable positioning piece, said rear foot is provided on an outer lateral side near the bottom end with a sleeve.

3. The combination structure of a swing chair used in a yard as in claim 1, wherein a bottom transverse rod for reinforcement is further mounted between two areas near said bottom ends of said front foot and said rear foot.

4. The combination structure of a swing chair used in a yard as in claim 1, wherein said swing chair is composed of foldable-for-stacking members including a seat portion, a chair back and two lateral armrests assemblable individually; for each of said two lateral armrests, a swayable connecting member has its upper end pivotally and movably connected with said top transverse rod and has its lower end assembled with said lateral armrest.

5. The combination structure of a swing chair used in a yard as in claim 4, wherein each of said two lateral armrests of said swing chair is composed of a straight pipe having a bottom end pivotally and movably connected with an outer edge of a seat portion as well as a resting plate having a rear end connected with a chair back, an upper end of said straight pipe and a front end of said resting plate are connected with each other; an outer lateral side of a bottom end of said straight pipe and an outer lateral side of a rear end of said resting plate respectively are provided with connecting bolts, said connecting bolts respectively have shanks of set sizes and diameters and heads with slightly larger diameters respectively in comparison with those of said shanks, said two lateral armrests are provided at positions in corresponding with those of said connecting bolts with slots having specific vertical lengths, said slots have on their top ends holes slightly larger than said heads; two feet of two lateral pending rods with different lengths of a swayable connecting member are adapted to connect movably with said connecting bolts.

6. The combination structure of a swing chair used in a yard as in claim 1, wherein said swing chair is provided on outer lateral sides of a seat portion and a chair back respectively with connecting bolts; said connecting bolts respectively have shanks of set sizes and diameters and heads with slightly larger diameters respectively in comparison with those of said shanks; said lateral armrests are provided at positions in corresponding with those of said connecting bolts with slots having specific vertical lengths, said slots have on their top ends holes slightly larger than said heads.

* * * * *